US011210982B2

(12) United States Patent
Zheng et al.

(10) Patent No.: US 11,210,982 B2
(45) Date of Patent: Dec. 28, 2021

(54) METHOD AND DEVICE FOR MURA DEFECT REPAIR

(71) Applicant: Wuhan Jingce Electronic Group Co., Ltd., Wuhan (CN)

(72) Inventors: Zengqiang Zheng, Wuhan (CN); Li Qin, Wuhan (CN); Zhao Liu, Wuhan (CN)

(73) Assignee: WUHAN JINGCE ELECTRONIC GROUP CO., LTD., Wuhan (CN)

( * ) Notice: Subject to any disclaimer, the term of this patent is extended or adjusted under 35 U.S.C. 154(b) by 206 days.

(21) Appl. No.: 16/571,225

(22) Filed: Sep. 16, 2019

(65) Prior Publication Data

US 2020/0013326 A1 Jan. 9, 2020

Related U.S. Application Data

(63) Continuation-in-part of application No. PCT/CN2017/117876, filed on Dec. 22, 2017.

(30) Foreign Application Priority Data

Mar. 15, 2017 (CN) ..... 201710151712.7

(51) Int. Cl.
*G09G 3/20* (2006.01)

(52) U.S. Cl.
CPC ..... *G09G 3/20* (2013.01); *G09G 2320/0233* (2013.01); *G09G 2320/0285* (2013.01); *G09G 2320/0626* (2013.01); *G09G 2360/16* (2013.01)

(58) Field of Classification Search
CPC ..... G09G 3/20; G09G 2320/0233; G09G 2320/0285; G09G 2320/0626; G09G 2360/16
See application file for complete search history.

(56) References Cited

U.S. PATENT DOCUMENTS 8,405,585 B2 * 3/2013 Wang ..... G09G 3/3225 345/82
8,743,215 B1 * 6/2014 Lee ..... G09G 3/20 348/189
9,464,962 B2 * 10/2016 Kim ..... G09G 3/3644
2003/0214586 A1 * 11/2003 Lee ..... G09G 3/006 348/180
2005/0007392 A1 * 1/2005 Kasai ..... G09G 3/3275 345/690
2007/0078343 A1 * 4/2007 Kawashima ..... G01S 7/52074 600/443

(Continued)

FOREIGN PATENT DOCUMENTS

CN 106097954 * 9/2016

*Primary Examiner* — Ricardo Osorio
(74) *Attorney, Agent, or Firm* — Matthias Scholl P.C.; Matthias Scholl

(57) ABSTRACT

A method of Mura defect repair, the method including: decoding an image input signal into pixel grayscale data of a frame image; looking up a DeMura lookup table and DeMura control data, and performing linear interpolation on Mura designated areas of the frame image according to the DeMura lookup table and DeMura control data to obtain compensation data of the Mura designated areas of the frame image; and superposing the compensation data and the pixel grayscale data of the frame image to obtain a compensated frame image signal.

6 Claims, 3 Drawing Sheets

(56) References Cited

U.S. PATENT DOCUMENTS

| | | | | |
|---|---|---|---|---|
| 2007/0132661 | A1* | 6/2007 | Shen | G09G 3/2007 345/3.4 |
| 2008/0238934 | A1* | 10/2008 | Daly | G09G 3/2007 345/617 |
| 2010/0013751 | A1* | 1/2010 | Kerofsky | G09G 3/3611 345/89 |
| 2011/0012908 | A1* | 1/2011 | Daly | G09G 3/006 345/581 |
| 2011/0234644 | A1* | 9/2011 | Park | G09G 3/3208 345/690 |
| 2012/0075354 | A1* | 3/2012 | Su | G09G 5/10 345/690 |
| 2015/0049958 | A1* | 2/2015 | Kamal | G09G 3/2044 382/266 |
| 2015/0235616 | A1* | 8/2015 | Wu | G09G 5/02 345/694 |
| 2015/0356929 | A1* | 12/2015 | Zhan | G09G 3/20 345/690 |
| 2016/0140917 | A1* | 5/2016 | Hyung | G09G 3/3648 345/694 |
| 2016/0171939 | A1* | 6/2016 | Na | G09G 3/20 345/690 |
| 2017/0243562 | A1* | 8/2017 | Hu | G09G 5/10 |
| 2018/0047368 | A1* | 2/2018 | Luo | G09G 5/10 |
| 2018/0075802 | A1* | 3/2018 | Liu | G09G 3/3233 |
| 2018/0166030 | A1* | 6/2018 | Liu | G09G 3/20 |
| 2018/0218693 | A1* | 8/2018 | Zhang | G09G 3/3607 |
| 2019/0122613 | A1* | 4/2019 | Furihata | G09G 3/3275 |

* cited by examiner

METHOD AND DEVICE FOR MURA DEFECT REPAIR

CROSS-REFERENCE TO RELATED APPLICATIONS

This application is a continuation-in-part of International Patent Application No. PCT/CN2017/117876 with an international filing date of Dec. 22, 2017, designating the United States, now pending, and further claims foreign priority benefits to Chinese Patent Application No. 201710151712.7 filed Mar. 15, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the technical field of display, and more particularly to a method and device for Mura defect repair.

Mura is a Japanese word meaning "unevenness; irregularity; lack of uniformity; nonuniformity; inequality". In the field of displaying, Mura means a visual difference of color or brightness of a picture under the same light source and the same background color, adversely affecting the quality of the flat display.

Conventional methods for repairing Mura defects are based on global repair, in which data is compressed in accordance with a fixed block size (an area size, for example 4×4, 8×8, etc.). For a single picture, only one compensation data value is required in each block size. For example, for a 3840×2160 module, when the block size is 8×8, 481×271 pieces of compensation data are stored, and the compensation data of other pixel points in the block size is calculated by linear interpolation. The calculation of the Mura compensation data by linear interpolation is essentially a process of smoothing the brightness value of the Mura defect. However, when the brightness of the Mura defect is distinctly different from that in the non-defect area in the block size, the Mura defect cannot be completely repaired.

SUMMARY OF THE DISCLOSURE

The disclosure provides a Mura defect repair method for repairing Mura detects in a designated position of a flat display module.

Provided is a method of Mura defect repair, the method comprising:

- decoding an image input signal into pixel grayscale data of a frame image;
- looking up a DeMura lookup table and DeMura control data, and performing linear interpolation on Mura designated areas of the frame image according to the DeMura lookup table and DeMura control data to obtain compensation data of the Mura designated areas of the frame image; and
- superposing the compensation data and the pixel grayscale data of the frame image to obtain a compensated frame image signal.

The DeMura lookup table comprises an upper grayscale bound and a lower grayscale bound; the DeMura control data comprises the number of Mura designated areas, the block size type, the horizontal coordinate of a starting point, the vertical coordinate of the starting point, the number of horizontal blocks and the number of vertical blocks of each Mura designated area.

The DeMura control data comprises a plurality of compensation grayscale nodes, and the DeMura lookup table comprises a plurality of node lookup tables in one-to-one correspondence to the plurality of compensation grayscale nodes.

When a grayscale value of a pixel point Px in the Mura designated areas is on one of the compensation grayscale nodes, acquire compensation data of adjacent pixel points M and N in the same row or column as the pixel point Px from a node lookup table corresponding to the one of the compensation grayscale nodes, and compensation data of the pixel point Px in the grayscale value is calculated by the following formula:

$$P=((X_N-X_{Px})\times M+(X_{Px}-X_M)\times N)/(X_N-X_M) \quad (1)$$

where the pixel points M and N are in the same row as the pixel point $P_x$, $X_{Px}$ represents the horizontal coordinate of the pixel point Px, P represents the compensation data of the pixel point $P_x$, $X_M$ represents the horizontal coordinate of the pixel point M, M represents the compensation data of the pixel point M, $X_N$ represents the horizontal coordinate of the pixel point N, and N represents the compensation data of the pixel point N;

or, compensation data of the pixel point Px in the grayscale value is calculated by the following formula:

$$P=((Y_N-Y_{Px})\times M+(Y_{Px}-Y_M)\times N)/(Y_N-Y_M) \quad (2)$$

where the pixel points M and N are in the same column as the pixel point Px, $Y_{Px}$ represents the vertical coordinate of the pixel point $P_x$, P represents the compensation data of the pixel point $P_x$, $Y_M$ represents the vertical coordinate of the pixel point M, M represents the compensation data of the pixel point M, $Y_N$ represents the vertical coordinate of the pixel point N, and N represents the compensation data of the pixel point N.

The DeMura control data comprises a plurality of compensation grayscale nodes, and the DeMura lookup table comprises a plurality of node lookup tables in one-to-one correspondence to the plurality of compensation grayscale nodes.

When a grayscale value of a pixel point Py in the Mura designated areas is between two adjacent compensation grayscale nodes Plane1 and Plane2, separately acquire compensation data of the pixel point Py when the grayscale value of the pixel point Py is on the two compensation grayscale nodes Plane1 and Plane2, and compensation data of the pixel point Py in the grayscale value T is calculated by the following formula:

$$P=((\text{Plane2}-T)\times S+(T-\text{Plane1})\times R)/(\text{Plane2}-\text{Plane1}) \quad (3)$$

where P represents the compensation data of the pixel point Py in the grayscale T; R represents the compensation data of the pixel point Py on the compensation grayscale node Plane2; and S represents the compensation data of the pixel point Py on the compensation grayscale node Plane1.

The Mura designated areas share the upper grayscale bound, the lower grayscale bound and the plurality of compensation grayscale nodes.

When the Mura designated areas are a single pixel point, the compensation data of the single pixel point is obtained from the DeMura lookup table.

When a pixel point Pc is located in a plurality of Mura designated areas, corresponding compensation data of the pixel point Pc in each of the Mura designated areas is accumulated.

The disclosure also provides a Mura defect repair device for repairing Mura defects of a flat display module. The Mura defect repair device comprises a Flash IC and a Tcon board. The Tcon board further comprises a DeMuraTcon IC. The Flash IC is configured to store a DeMura lookup table and DeMura control data. The DeMuraTcon IC is configured to acquire compensation data for Mura designated areas of the flat display module according to the DeMura lookup table and the DeMura control data.

The DeMuraTcon IC is further configured to decode an image signal into pixel grayscale data of a frame image and then superpose the compensation data and the pixel grayscale data of the frame image to obtain a compensated frame image signal.

The DeMura lookup table comprises an upper grayscale bound and a lower grayscale bound; the DeMura control data comprises the number of Mura designated areas, the block size type, the horizontal coordinate of a starting point, the vertical coordinate of the starting point, the number of horizontal blocks and the number of vertical blocks of each Mura designated area.

The method and device of the disclosure have the following advantages.

1) The Mura defect areas and pixel points of a flat display module can be targeted for repair, and the accuracy of Mura defect repair is improved without increasing the hardware cost with respect to conventional repair methods.

2) The method and device can synchronously repair a plurality of Mura defect areas of different types and different sizes of a flat display module.

DETAILED DESCRIPTION OF THE DISCLOSURE

In this embodiment, the description will be given by using, as an example, repairing Mura defects of a flat display module with a 10-bit processing system (i.e., 1024 grayscales) and a resolution of 3840×2160.

Figure 1:
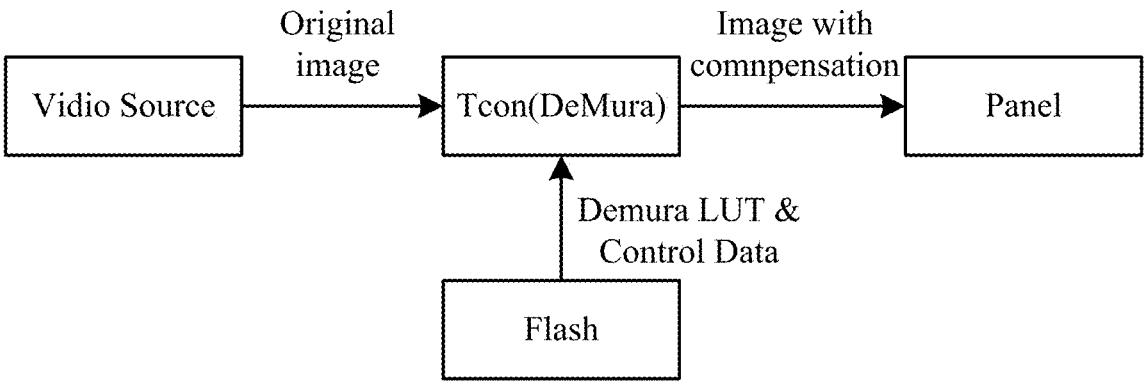
FIG. 1 is a schematic diagram of a Mura defect repair device according to one embodiment of the disclosure.

The hardware in this embodiment mainly comprises a Flash IC, and a Tcon board comprising a DeMuraTcon IC. The Flash IC is mainly configured to store DeMura LUT (a DeMura lookup table) and DeMura control data input by an external Mura defect inspection device. The DeMuraTcon IC is mainly configured to: load the DeMura LUT and the DeMura control data from the Flash IC, decode an image input by an image input signal into grayscale data of each picture and each pixel point, calculate compensation data for each pixel (sub-pixel) according to the grayscale, the location, the corresponding DeMura LUT and the DeMura control data, superpose the grayscale of this pixel and the compensation data to obtain a compensated grayscale value, and output the compensated grayscale value to the flat display module for display, as shown in FIG. 1.

In this embodiment, for an existing flat display module, particularly for a large-size flat display module, the PCB board generally comprises a Flash IC for storing Gamma data, manufacturer ID and other information. The DeMura LUT and DeMura control data used in this embodiment are all stored in the Flash IC.

In this embodiment, the DeMura control data comprises Mura overall control data and Mura area control data. The Mura overall control data comprises Higbound (upper grayscale bound), Lowbound (lower grayscale bound), a plurality of compensation grayscale nodes Plane and the number of Mura designated areas. As shown in Table 1, in this embodiment, the Higbound is 1000, the Lowbound is 20, the compensation grayscale node Planet is 100, the compensation grayscale node Plane2 is 240, the compensation grayscale node Plane3 is 900, and the number of Mura designated areas is 3. The Mura area control data refers to parameters for each Mura designated area, comprising the block size (area size) type, the horizontal coordinate of the starting point, the vertical coordinate of the starting point, the number of horizontal blocks (areas) and the number of vertical block, wherein the block size type information contains multiple sets of preset values, for example, 16×16, 8×8, 1×8, 8×1, 1×1, etc., and different block size types are used for compensating different types of defects, as shown in Table 2. It is to be noted that, in this embodiment, all Mura designated areas share the Higbound, the Lowbound and the plurality of compensation grayscale nodes Plane.

TABLE 1

| | |
|---|---|
| Lowbound | 20 |
| Plane1 | 100 |
| Plane2 | 240 |
| Plane3 | 900 |
| Highbound | 1000 |
| The number of Mura designated areas | 3 |

TABLE 2

| block size type | Type of defects to be compensated |
|---|---|
| 16 × 16 | Large-area Mura |
| 8 × 8 | Large-area Mura |
| 1 × 8 | Vertical splicing line, vertical black/white zone |
| 8 × 1 | Horizontal splicing line, horizontal black/white zone |
| 1 × 1 | Water stain Mura, black/white Gap |

In this embodiment, the DeMura LUT comprises a plurality of node lookup tables Plane LUT (Planet LUT, Plane2 LUT, Plane3 LUT . . . PlaneN LUT) in one-to-one correspondence to the plurality of compensation grayscale nodes Plane. Since each compensation grayscale node Plane corresponds to one node lookup table, the number of the compensation grayscale nodes Plane determines the number of node lookup tables for each Mura designated area. In this embodiment, the description will be given by using, as an example, three compensation grayscale nodes Planet, Plane2 and Plane3 and three node lookup tables Planet LUT, Plane2 LUT and Plane3 LUT.

In this embodiment, for a plurality of Mura designated areas, the DeMuraTcon IC generates the location and block size (an accurate rectangular area) for each of the plurality of Mura designated areas according to the corresponding Mura area control data, as shown in Tables 3-5. The DeMura LUT performs linear interpolation according to the block size of this Mura Designated area (if the set block size type is 1×1, it is unnecessary to perform linear interpolation, and the compensation data is directly obtained from the corresponding node lookup table) to generate compensation data for each pixel point in this Mura designated area, so as to obtain a Mura compensation data matrix for each Mura designated area.

TABLE 3

| Control data of the Mura designated area 1 | |
|---|---|
| Block size type | 0 (representing a block size of 16 × 16) |
| Horizontal coordinate of the starting point | 0 |
| Vertical coordinate of the starting point | 0 |
| The number of horizontal blocks | 241 |
| The number of vertical blocks | 136 |

TABLE 4

| Control data of the Mura designated area 2 | |
|---|---|
| Block size type | 2 (representing a block size of 1 × 8) |
| Horizontal coordinate of the starting point | 2060 |
| Vertical coordinate of the starting point | 0 |
| The number of horizontal blocks | 10 |
| The number of vertical blocks | 271 |

TABLE 5

| Control data of the Mura designated area 3 | |
|---|---|
| Block size type | 3 (representing a block size of 1 × 1) |
| Horizontal coordinate of the starting point | 2050 |
| Vertical coordinate of the starting point | 1800 |
| The number of horizontal blocks | 40 |
| The number of vertical blocks | 60 |

In this embodiment, the specific operating process of the DeMuraTcon IC is as follows.

1) The DeMuraTcon IC loads the DeMura control data and the DeMura LUT from the Flash CI. This process is automatically executed after the flat display module is activated at the first time, and will not be executed again after completion.

2) The DeMuraTcon IC determines which Mura designated area the pixel point to be repaired is located in, which block of the Mura designated area this pixel point is located in and which compensation grayscale node interval the grayscale of this pixel point is located in, and then calculates compensation data for this pixel point by linear interpolation on the basis of location and grayscale.

Figure 2:
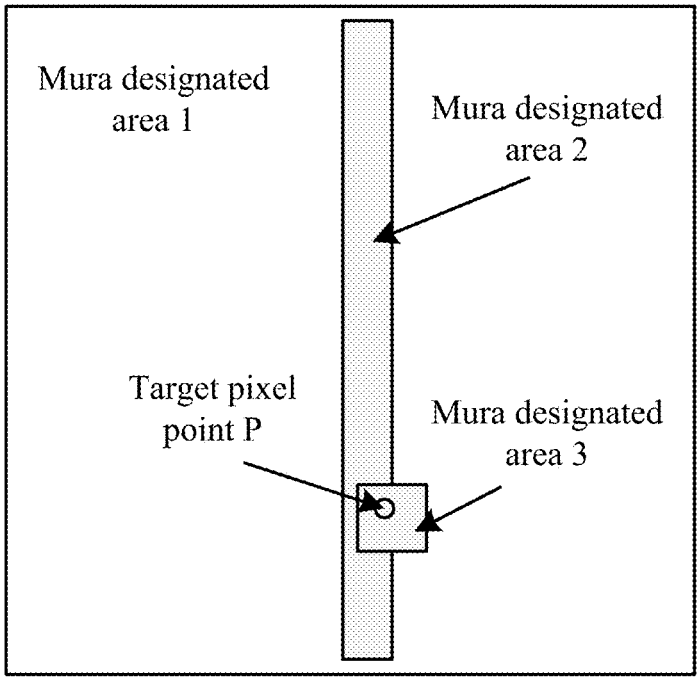
FIG. 2 is a schematic view of a plurality of Mura designated areas according to one embodiment of the disclosure.

3) The DeMuraTcon IC accumulates the corresponding compensation data for this pixel point in each Mura designated area to obtain final compensation data (if this pixel point is located in only one Mura designated area, the corresponding compensation data in other Mura designated areas is defaulted as 0 during the superposition), and superposes the final compensation data onto the original grayscale data of this pixel point to obtain a compensated grayscale value of this pixel point, as shown in FIG. 2.

Figure 3:
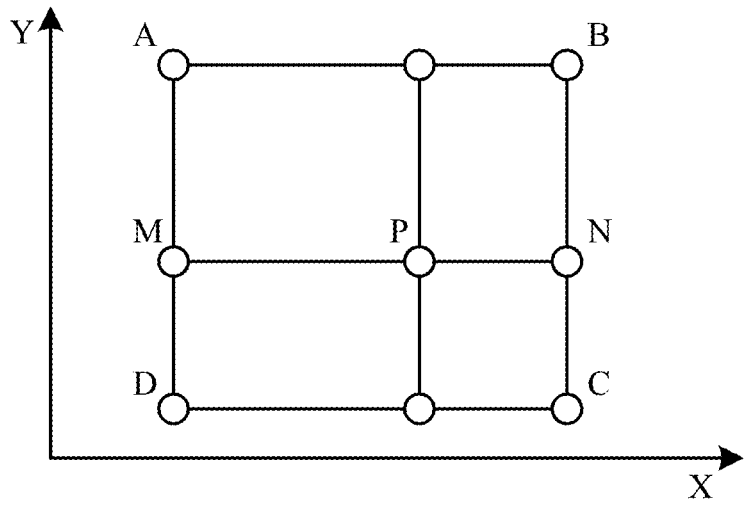
FIG. 3 is a schematic view of a target pixel point and adjacent pixel points thereof according to one embodiment of the disclosure.

In this embodiment, when a grayscale value of a certain pixel point in any Mura designated area is on a certain compensation grayscale node, the compensation data for this pixel point is calculated by linear interpolation according to the node lookup table corresponding to this compensation grayscale node, that is, the compensation data of the target pixel point in the current grayscale is calculated by linear interpolation on the basis of location. As shown in FIG. 3, P is a target pixel point to be compensated, A, B, C and D are nodes at four adjacent locations obtained from the DeMura control data, and the compensation data of the four points A, B, C and D can be directly obtained from the node lookup table corresponding to the compensation grayscale node. Thus, the compensation data of the pixel point P can be calculated by the following formulae:

$$M=((Y_M-Y_A)\times D+(Y_D-Y_M)\times A)/(Y_D-Y_A),$$

$$N=((Y_N-Y_B)\times C+(Y_C-Y_N)\times B)/(Y_C-Y_B),$$

$$P=((X_N-X_P)\times M+(X_P-X_M)\times N)/(X_N-X_M),$$

where $X_P$ represents the horizontal coordinate of the point P, and P represents the compensation data of the point P; $X_M$ and $Y_M$ represent the horizontal and vertical coordinates of the point M, and M represents the compensation data of the point M; $X_N$ and $Y_N$ represent the horizontal and vertical coordinates of the point N, and N represents the compensation data of the point N; $Y_A$ represents the vertical coordinate of the point A, and A represents the compensation data of the point A; $Y_B$ represents the vertical coordinate of the point B, and B represents the compensation data of the point B; $Y_C$ represents the vertical coordinate of the point C, and C represents the compensation data of the point C; and, $Y_D$ represents the vertical coordinate of the point D, and D represents the compensation data of the point D.

The Mura repairing of the pixel point P (2067,1850) will be described below with reference to FIG. 5.

In this embodiment, the Mura designated area 1 is an integral large-area Mura, and the corresponding Mura designated area control data is set as shown in Table 3. Thus, the compensation range for the Mura designated area 1 is (240×16)×(135×16)=(3840×2160), so that compensation can be performed for the whole screen. In this embodiment, the description will be given by using, as an example, the calculation of the compensation data of the pixel point P (2067,1850) in a grayscale of 240 (i.e., Plane2). In a block size of 16×16 using (0,0) as an origin, the coordinates of four compensation nodes closest to this point are A (2064,1840), B (2080,1840), C (2080,1856) and D (2064,1856), respectively. If the compensation data of the four points in the grayscale of 240 is A=−5, B=2, C=4 and D=−2 (the values are obtained from the Plane2 LUT), respectively, the compensation data P1 for the point P (2067,1850) in the grayscale of 240 can be calculated as −1.9297 by the following calculation formulae:

$$M=((1850-1840)\times(-2)+(1856-1850)\times(-5))/(1856-1840)=-3.125,$$

$$N=((1850-1840)\times 4+(1856-1850)\times 2)/(1856-1840)=3.25,$$

$$P1=((2080-2067)\times M+(2067-2064)\times N)/(2080-2064)=-1.9297.$$

The Mura designated area control data corresponding to the Mura designated area 2 is set as shown in Table 4. Thus, the compensation range for the Mura designated area 2 is (9×1)×(270×8)=(9×2160), so that an area where the vertical splicing line is located can be compensated. In a block size of 1×8 using (2060,0) as an origin, the coordinates of two compensation nodes closest to the point P (2067,1850) are E (2076,1848) and F (2067,1856), respectively. If the compensation data of the two points in a grayscale of 240 is E=6 and F=9, respectively, the compensation data P2 for the pixel point P (2067,1850) in the grayscale of 140 can be calculated as 6.75 by the following calculation formula:

$$P2=((1856-1850)\times 6+(1850-1848)\times 9)/(1856-1848)=6.75.$$

The Mura designated area control data corresponding to the Mura designated area 3 is set as shown in Table 5. Thus, the compensation range of the Mura designated area 3 is a single pixel point. Since the pixel point P (2067,1850) is exactly contained in the Mura designated area 3, the compensation data of the point P in the designated area 3 in a grayscale of 240 is directly obtained from the Plane2 LUT, i.e., P3=3.0.

Figure 5:
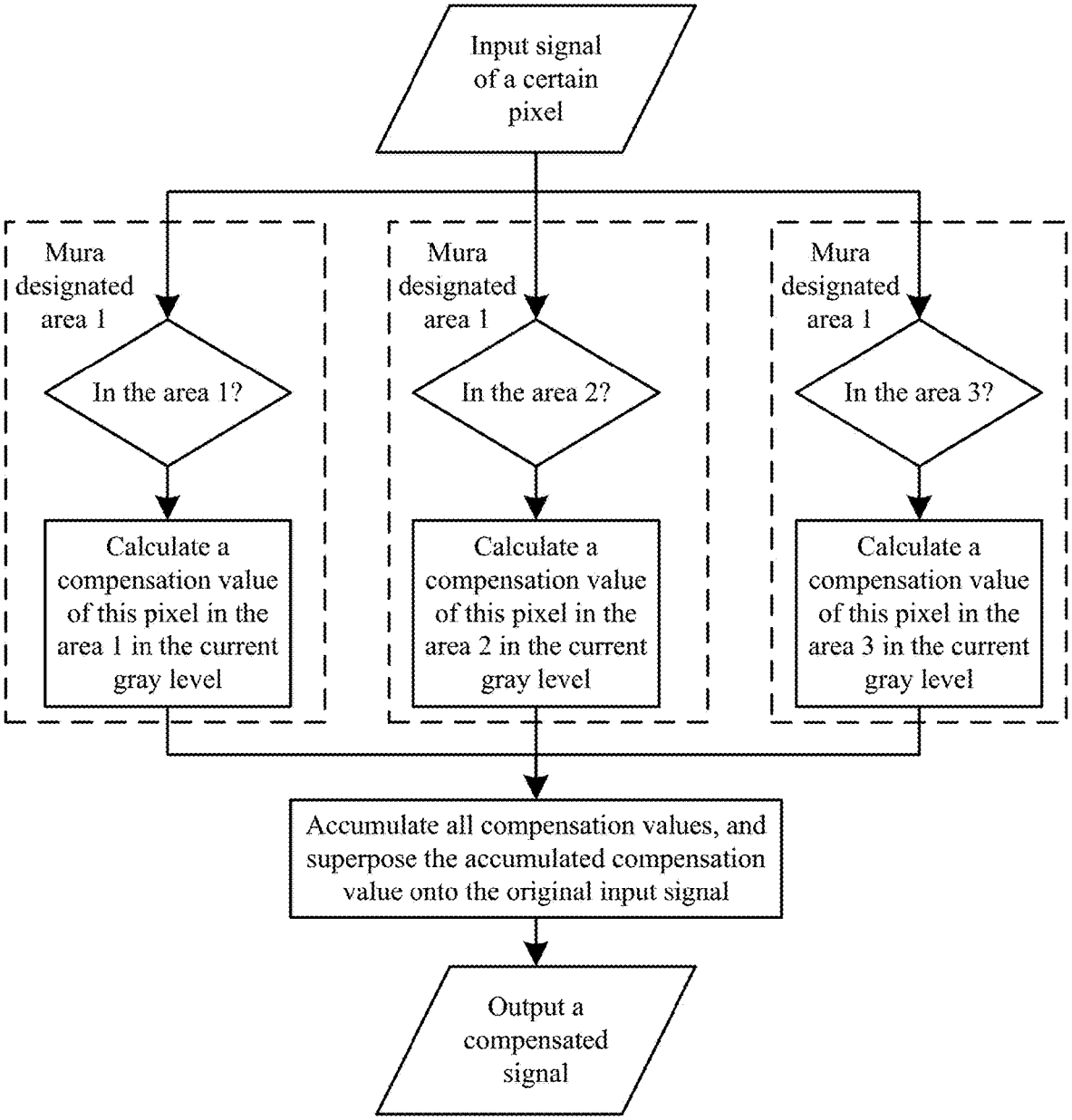
FIG. 5 is a flowchart of repairing a single pixel point according to one embodiment of the disclosure.

As shown in FIGS. 2 and 5, the final compensation data of the pixel point P (2067,1850) in Plane2 is: P=P1+P2+P3=7.8203.

Figure 4:
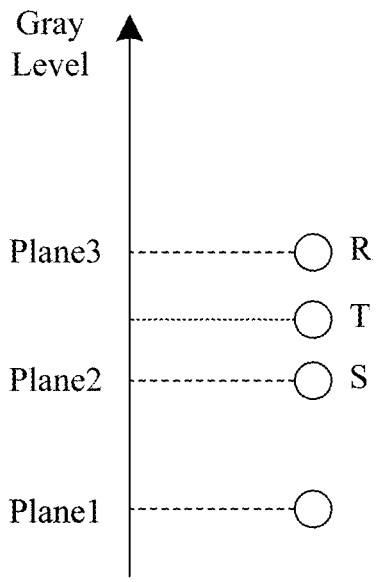
FIG. 4 is a schematic view of the relationship between the compensation data of a target pixel point and corresponding compensation grayscale nodes according to one embodiment of the disclosure.

In this embodiment, when a grayscale value of a certain pixel point in any Mura designated area is between two compensation grayscale nodes, the compensation data for this pixel point is calculated by linear interpolation according to two node lookup tables corresponding to the two compensation grayscale nodes, that is, the compensation data of the target pixel point in a target grayscale is calculated by linear interpolation on the basis of grayscale. As shown in FIG. 4, R and S are compensation data of the target pixel point in grayscales Plane3 and Plane2. Thus, the compensation data of the target pixel point P in a grayscale T is calculated by the following formula:

$$PT=((\text{Plane3}-T)\times S+(T-\text{Plane2})\times R)/(\text{Plane3}-\text{Plane2}).$$

For example, if the final compensation data of the pixel point P in Plane2 is 7.8203 (this value is obtained from the Plane2 LUT) and the final compensation data of the pixel point P in Plane1 is 20.5 (this value is obtained from the Plane1 LUT), the compensation data of the pixel point P in a grayscale of 120 is:

$$P120=(7.8203\times(120-100)+20.5\times(240-120))/(240-100)=18.6886.$$

To further explain the Mura defect repair process of the flat display module, the following description will be given by using, as an example, the repair of an image block in 2×2 consisting of four pixel points (2067,1849), (2068,1849), (2067,1850) and (2068,1850) in the Mura designated area 1 shown in Table 3. In this embodiment, the node lookup tables corresponding to the Lowbound and Highbound are 0.

It is assumed that the pixel grayscale data of a 2×2 matrix in a certain frame image is:

$$\begin{bmatrix} 80 & 200 \\ 240 & 950 \end{bmatrix}$$

where the pixel grayscale of the point (2067,1849) is 80. It can be known from Table 1 and FIG. 4 that, if the pixel grayscale of the point (2067,1849) is between the Lowbound and the plane1, the compensation data for this pixel point in a pixel grayscale of 80 is calculated by linear interpolation according to the compensation data corresponding to this location point on two compensation grayscale nodes. If it is assumed that the compensation data corresponding to this point in plane1 is 5.5 (this value is obtained from the Plane1 LUT), the compensation data for this pixel point in the pixel grayscale of 80 can be calculated by the following formula:

$$P80=((100-80)\times 0+(80-20)\times 5.5)/(100-20)=4.125.$$

The pixel grayscale of the point (2067,1850) is 240. It can be known from Table 1 and FIG. 4 that the pixel grayscale of the point (2067,1850) is in plane2. It is assumed that the coordinates of four complementation grayscale nodes closest to this pixel point are A (2064,1840), B (2080,1840), C (2080,1856) and D (2064,1856), respectively. If the compensation data of the four points in plane2 is A=−5, B=2, C=4 and D=−2 (the values are obtained from the Plane2 LUT), respectively, the compensation data P240 for the point (2067,1850) in the grayscale of 240 can be calculated as −1.9297 by the following calculation formulas:

$$M=((1850-1840)\times(-2)+(1856-1850)\times(-5))/(1856-1840)=-3.125,$$

$$N=((1850-1840)\times 4+(1856-1850)\times 2)/(1856-1840)=3.25,$$

$$P240=((2080-2067)\times M+(2067-2064)\times N)/(2080-2064)=-1.9297.$$

The pixel grayscale of the point (2068, 1849) is 200. It can be known from Table 1 and FIG. 4 that, if the pixel grayscale of the point (2068, 1849) is between the plane1 and the plane2, the compensation data for this pixel point in the pixel grayscale of 200 is calculated by linear interpolation according to the compensation data corresponding to this location point on two compensation grayscale nodes. If it is assumed that the compensation data corresponding to this point in plane1 is 5.5 (this value is obtained from the Plane1 LUT) and the compensation data corresponding to this point in plane2 is −2.5 (this value is obtained from the Plane2 LUT), the compensation data for this pixel point in the pixel grayscale of 200 can be calculated by the following formula:

$$P200=((200-100)\times -2.5+(240-200)\times 5.5)/(240-100)=-0.25.$$

The pixel point grayscale of the point (2068, 1850) is 950. It can be known from Table 1 and FIG. 4 that, if the pixel grayscale of the point (2068, 1850) is between the plane3 and the Highbound, the compensation data for this pixel point in the pixel grayscale of 950 is calculated by linear interpolation according to the compensation data corresponding to this location point on two compensation grayscale nodes. If it is assumed that the compensation data corresponding to this point in plane3 is 1.55 (this value is obtained from the Plane3 LUT), the compensation data for this pixel point in the pixel grayscale of 950 can be calculated by the following formula:

$$P950=((1000-950)\times 1.55+(950-900)\times 0)/(1000-900)=0.775.$$

Through the above calculations, it can be known that the grayscale compensation data corresponding to the 2×2 matrix is:

$$\begin{bmatrix} 4.125 & -0.25 \\ -1.929 & 0.775 \end{bmatrix}.$$

Then, the grayscale value of the 2×2 matrix finally displayed on the flat display module is:

$$\begin{bmatrix} 80 & 200 \\ 240 & 950 \end{bmatrix} + \begin{bmatrix} 4.125 & -0.25 \\ -1.929 & 0.775 \end{bmatrix} = \begin{bmatrix} 84.125 & 199.75 \\ 238.071 & 950.775 \end{bmatrix}.$$

It will be obvious to those skilled in the art that changes and modifications may be made, and therefore, the aim in the appended claims is to cover all such changes and modifications.

What is claimed is:

1. A method, comprising:

1) decoding an image input signal into pixel grayscale data of a frame image;

2) looking up a DeMura lookup table and DeMura control data; and performing linear interpolation on Mura designated areas of the frame image according to the DeMura lookup table and DeMura control data, to obtain compensation data of the Mura designated areas of the frame image; and 3) superposing the compensation data and the pixel grayscale data of the frame image to obtain a compensated frame image signal;

wherein:

the DeMura control data comprises a plurality of compensation grayscale nodes, and the DeMura lookup table comprises a plurality of node lookup tables in one-to-one correspondence to the plurality of compensation grayscale nodes;

when a grayscale value of a pixel point Px in the Mura designated areas is on one of the compensation grayscale nodes, acquire compensation data of adjacent pixel points M and N in the same row or column as the pixel point Px from a node lookup table corresponding to the one of the compensation grayscale nodes, and compensation data of the pixel point Px in the grayscale value is calculated by the following formula:

$$P=((X_N-X_{Px})\times M+(X_{Px}-X_M)\times N)/(X_N-X_M) \quad (1)$$

the pixel points M and N are in the same row as the pixel point $P_x$; $X_{Px}$ represents a horizontal coordinate of the pixel point Px, and P represents the compensation data of the pixel point $P_x$; $X_M$ represents a horizontal coordinate of the pixel point M, and M represents the compensation data of the pixel point M; $X_N$ represents a horizontal coordinate of the pixel point N, and N represents the compensation data of the pixel point N;

or, compensation data of the pixel point $P_x$ in the grayscale value is calculated by the following formula:

$$P=((Y_N-Y_{Px})\times M+(Y_{Px}-Y_M)\times N)/(Y_N-Y_M) \quad (2)$$

the pixel points M and N are in the same column as the pixel point $P_x$; $Y_{Px}$ represents a vertical coordinate of the pixel point $P_x$, and P represents the compensation data of the pixel point $P_x$; $Y_M$ represents a vertical coordinate of the pixel point M, and M represents the compensation data of the pixel point M; $Y_N$ represents a vertical coordinate of the pixel point N, and N represents the compensation data of the pixel point N.

2. The method of claim 1, wherein the Mura designated areas share the upper grayscale bound, the lower grayscale bound and the plurality of compensation grayscale nodes.

3. The method of claim 1, wherein when a pixel point Pc is located in a plurality of Mura designated areas, corresponding compensation data of the pixel point Pc in each of the Mura designated areas is accumulated.

4. A method, comprising:

1) decoding an image input signal into pixel grayscale data of a frame image;

2) looking up a DeMura lookup table and DeMura control data; and performing linear interpolation on Mura designated areas of the frame image according to the DeMura lookup table and DeMura control data, to obtain compensation data of the Mura designated areas of the frame image; and 3) superposing the compensation data and the pixel grayscale data of the frame image to obtain a compensated frame image signal;

wherein:

the DeMura control data comprises a plurality of compensation grayscale nodes, and the DeMura lookup table comprises a plurality of node lookup tables in one-to-one correspondence to the plurality of compensation grayscale nodes;

when a grayscale value of a pixel point Py in the Mura designated areas is between two adjacent compensation grayscale nodes Plane1 and Plane2, separately acquire compensation data of the pixel point Py when the grayscale value of the pixel point Py is on the two compensation grayscale nodes Plane1 and Plane2, and compensation data of the pixel point Py in the grayscale value T is calculated by the following formula:

$$P=((\text{Plane2}-T)\times S+(T-\text{Plane1})\times R)/(\text{Plane2}-\text{Plane1}) \quad (3)$$

P represents the compensation data of the pixel point Py in the grayscale T; R represents the compensation data of the pixel point Py on the compensation grayscale node Plane2; and S represents the compensation data of the pixel point Py on the compensation grayscale node Plane1.

5. The method of claim 4, wherein the Mura designated areas share the upper grayscale bound, the lower grayscale bound and the plurality of compensation grayscale nodes.

6. The method of claim 4, wherein when a pixel point Pc is located in a plurality of Mura designated areas, corresponding compensation data of the pixel point Pc in each of the Mura designated areas is accumulated.

* * * * *